US010111001B2

(12) United States Patent
Sapozhnykov et al.

(10) Patent No.: US 10,111,001 B2
(45) Date of Patent: Oct. 23, 2018

(54) METHOD AND APPARATUS FOR ACOUSTIC CROSSTALK CANCELLATION

(71) Applicant: Cirrus Logic International Semiconductor Ltd., Edinburgh (GB)

(72) Inventors: Vitaliy Sapozhnykov, Cheltenham (AU); Henry Chen, Glenhuntly (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/708,890

(22) Filed: Sep. 19, 2017

(65) Prior Publication Data

US 2018/0098152 A1 Apr. 5, 2018

Related U.S. Application Data

(60) Provisional application No. 62/404,562, filed on Oct. 5, 2016.

(51) Int. Cl.

| | |
|---|---|
| ***H04R 3/14*** | (2006.01) |
| ***H04R 5/04*** | (2006.01) |
| *H04R 3/04* | (2006.01) |

(52) U.S. Cl.

CPC ..... *H04R 3/14* (2013.01); *H04R 5/04* (2013.01); *H04R 3/04* (2013.01); *H04R 2430/01* (2013.01)

(58) Field of Classification Search

CPC ..... H04R 25/552; H04R 1/10; H04R 3/12

See application file for complete search history.

(56) References Cited

U.S. PATENT DOCUMENTS

| | | | |
|---|---|---|---|
| 6,424,719 | B1 | 7/2002 | Elko et al. |
| 6,760,447 | B1 | 7/2004 | Nelson et al. |
| 7,835,535 | B1 | 11/2010 | Trautmann et al. |
| 2003/0161478 | A1 | 8/2003 | Nelson et al. |
| 2007/0019812 | A1 | 1/2007 | Kim |
| 2007/0076892 | A1 | 4/2007 | Kim |
| 2010/0232617 | A1 | 9/2010 | Hartung et al. |
| 2011/0274283 | A1 | 11/2011 | Athanas |
| 2011/0305358 | A1 | 12/2011 | Nishio et al. |
| 2013/0163766 | A1 | 6/2013 | Choueiri |

(Continued)

FOREIGN PATENT DOCUMENTS

| | | | |
|---|---|---|---|
| EP | 1696702 | A1 | 8/2006 |
| EP | 2612437 | A1 | 7/2013 |

(Continued)

OTHER PUBLICATIONS

Edgar (Choueiri, Edgar Y. "Optimal crosstalk cancellation for binaural audio with two loudspeakers." Princeton University (2008): 28).*

(Continued)

*Primary Examiner* — Mohammad Islam

(74) *Attorney, Agent, or Firm* — Jackson Walker L.L.P.

(57) ABSTRACT

A crosstalk canceller for reducing acoustic crosstalk at a time of audio playback is derived by forming a channel frequency response for a nominated playback geometry, and decomposing the channel frequency response to derive a decomposition element such as a singular value decomposition matrix. A value of the decomposition element, such as the smallest singular value, is then adjusted to reduce spectral coloration, and filter coefficients of a crosstalk cancellation filter are derived from the adjusted decomposition element.

25 Claims, 8 Drawing Sheets

(56) References Cited

U.S. PATENT DOCUMENTS

| | | | | |
|---|---|---|---|---|
| 2013/0216071 | A1 | 8/2013 | Maher et al. | |
| 2014/0064526 | A1 | 3/2014 | Otto et al. | |
| 2015/0172812 | A1* | 6/2015 | Wu | H04R 3/12 381/71.1 |
| 2016/0150339 | A1 | 5/2016 | Choueiri | |
| 2016/0227338 | A1* | 8/2016 | Oh | H04S 7/303 |
| 2017/0272882 | A1* | 9/2017 | Oh | H04S 3/008 |
| 2017/0325042 | A1* | 11/2017 | Lacouture Parodi | H04S 7/30 |

FOREIGN PATENT DOCUMENTS

| | | | |
|---|---|---|---|
| WO | 2006076926 | A2 | 7/2006 |
| WO | 2009004352 | A1 | 1/2009 |
| WO | 2016033358 | A1 | 3/2016 |
| WO | 2016131471 | A1 | 8/2016 |

OTHER PUBLICATIONS

Combined Search and Examination Report, UKIPO, Application No. GB1715062.4, dated Mar. 19, 2018.

Combined Search and Examination Report, UKIPO, Application No. GB1703522.1, dated Sep. 15, 2017.

International Search Report and Written Opinion of the International Searching Authority, International Application No. PCT/IB2017/051219, dated Jun. 9, 2017.

* cited by examiner

METHOD AND APPARATUS FOR ACOUSTIC CROSSTALK CANCELLATION

FIELD OF THE INVENTION

The present invention relates to speaker playback of stereo or multichannel audio signals, and in particular relates to a method and apparatus for processing such signals prior to playback in order to improve the audible stereo effect presented to a listener upon playback.

BACKGROUND OF THE INVENTION

Stereo playback of audio signals typically involves delivering a left audio signal channel and a right audio signal channel to respective left and right speakers. However, stereo playback depends upon the left and right speakers being positioned sufficiently widely apart relative to the listener. In particular there must be a relatively large difference between the angles of incidence of the respective acoustic signals from the left and right speakers in order for the listener's natural binaural stereo hearing to produce a stereo perception. This is because if playback occurs from two relatively closely spaced loudspeakers which present a relatively small difference in angle of incidence of the respective acoustic signals, then the audio from each respective speaker is also heard by the contralateral ear at a similar amplitude and with relatively little differential delay. This effect is known as acoustic crosstalk. The perceptual result of crosstalk is that perceived stereo cues of the played audio may be severely deteriorated, so that little or no stereo effect is perceived.

Acoustic crosstalk can be sufficiently avoided, and a stereo perception can be delivered to the listener(s), by placing the left and right speakers far apart relative to the listener(s), such as many meters apart at opposite sides of a room or theatre. However, this is not possible when using a physically compact audio playback device such as a smartphone or tablet, as the onboard speakers of such devices cannot be positioned far apart relative to the listener. Smart phones are typically around 80-150 mm on the longest dimension, while tablets are typically around 170-250 mm on the longest dimension, and in such devices the onboard speakers can be positioned no further apart than the furthest apart corners or sides of the respective device. Even if the device is brought inconveniently close to the listener in an attempt to increase the difference between the respective angles of incidence of the left and right acoustic signals to the listener's ears, this still fails to generate any significant stereo perception from the onboard speakers due to the small size of the compact device.

To date the only way to achieve a suitable perceptible stereo playback when using compact playback devices is to use additional external speakers, such as headphone speakers or loudspeakers, driven from the playback device. However this introduces additional cost, size and weight of such external hardware and runs counter to the intended compact and lightweight mode of use of compact devices, while also reducing the achieved utility of the onboard speakers.

Attempts have been made to pre-process the left and right channels prior to playback in order to cancel acoustic crosstalk and provide the listener with a stereo perception when the speakers are relatively close together. However, these approaches have suffered from a number of problems including being highly sensitive to the position of the listener's head relative to the playback device, whereby even very slight head movements significantly diminish the perceived stereo effect and rapidly escalate spectral coloration producing unpleasant sound corruption, and also adding a substantial load on both transducers.

Past attempts at acoustic crosstalk cancellation (XTC) have also suffered from a failure to optimise crosstalk cancellation evenly across the audio spectrum. It has been suggested to resolve this by frequency dependent regularisation involving hierarchical spectral division responsive to listening conditions, however this entails determining the frequency divisions and in turn complicates the crosstalk canceller design, which imports a significant processing burden and increased memory requirements, which is undesirable for typical compact playback devices. In particular the band branching method requires the input audio to be divided into numerous sub-bands, the widths of which are dependent on the playback geometry, sampling frequency etc. Then, each band is processed separately by a XTC design specifically for each band using a corresponding regularisation parameter. This is thus a complex XTC structure which undesirably increases processor and memory requirements of the crosstalk canceller.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect, the present invention provides a device for reducing acoustic crosstalk at a time of audio playback, the device comprising:

a processor configured to pass a stereo audio signal through a crosstalk canceller, wherein the crosstalk canceller comprises a filter having filter coefficients derived from a decomposition element in which at least one value is adjusted to reduce spectral coloration.

According to a second aspect, the present invention provides a method of reducing acoustic crosstalk at a time of audio playback, the method comprising:

passing a stereo audio signal through a crosstalk canceller, wherein the crosstalk canceller comprises a filter having filter coefficients derived from a decomposition element in which at least one value is adjusted to reduce spectral coloration.

According to a third aspect, the present invention provides a method of designing a crosstalk canceller for reducing acoustic crosstalk at a time of audio playback, the method comprising:

forming a channel frequency response for a nominated playback geometry;

decomposing the channel frequency response to derive a decomposition element;

adjusting a value of the decomposition element to reduce spectral coloration; and deriving crosstalk canceller filter coefficients from the adjusted value of the decomposition element.

According to a fourth aspect, the present invention provides a non-transitory computer readable medium for reducing acoustic crosstalk at a time of audio playback, comprising instructions which, when executed by one or more processors, causes passing of a stereo audio signal through a crosstalk canceller, wherein the crosstalk canceller comprises a filter having filter coefficients derived from a decomposition element in which at least one value is adjusted to reduce spectral coloration.

According to a fifth aspect the present invention provides a crosstalk cancellation module configured to pass a stereo audio signal through a crosstalk canceller, wherein the crosstalk cancellation module comprises a filter having filter coefficients derived from a decomposition element in which at least one value is adjusted to reduce spectral coloration.

In some embodiments of the invention, the decomposition element may comprise a singular value decomposition element of a channel frequency response matrix. In such embodiments, the value adjusted may be a singular value. In other embodiments, the decomposition element may comprise an eigenvalue decomposition element of a channel frequency response matrix, and the value adjusted in such embodiments may be an eigenvalue. That is, both singular values and eigenvalues are considered to be decomposition elements within the meaning of this phrase as defined herein.

Where the decomposition element comprises a singular value, some embodiments may provide for a singular value having smallest magnitude to be adjusted to take a value $\tilde{\lambda}$ across all frequencies. The decomposition element may for example comprise a pseudo-inverse of a singular value matrix comprising at least one adjusted singular value. The decomposition element may, in some embodiments, be normalised to provide 0 dB maximum gain.

Reducing spectral coloration may be thought of as means to selectively modify XTC gains on a frequency basis. Thus, the trade off of coloration to crosstalk reduction can be implemented in a frequency dependent manner some embodiments may thus provide that at one frequency a first amount of coloration and crosstalk cancellation is selected, by making a first appropriate adjustment of the respective decomposition element, and that at another frequency a second amount of coloration and crosstalk cancellation is selected, by making a second appropriate adjustment of the respective decomposition element. For example some embodiments may adjust the respective decomposition elements to reflect that in higher frequencies stereo perceptions are poorly conveyed, with correspondingly reduced motivation to provide crosstalk reduction, whereas in lower frequencies an increased amount of crosstalk reduction may be sought, resulting in a frequency dependent trade off of coloration to crosstalk reduction. In some such embodiments, the frequency dependent trade off may be controlled by user definition or manufacturer definition of frequency dependent coloration selection parameters.

In some embodiments of the invention, the crosstalk cancellation module may comprise more than one crosstalk cancellation filter, each having filter coefficients derived from a decomposition element of a respective channel frequency response matrix in which at least one value is adjusted to reduce spectral coloration. For example a first cancellation filter may be derived from a respective channel frequency response matrix reflecting a spatial channel when a playback device is held in a landscape orientation, and a second cancellation filter may be derived from a respective channel frequency response matrix reflecting a spatial channel when a playback device is held in a portrait orientation. In such embodiments, audio playback may be passed through a selected one of the crosstalk cancellation filters, selected according to whether the device is oriented in a landscape or portrait position. To this end, other cancellation filters may additionally or alternatively be provided which are derived from a respective channel frequency response matrix reflecting a spatial channel when the playback device is hand-held, or is flat on a surface, or is propped up at an angle to a surface, with suitable device sensor input being utilised to identify device position and select an appropriate cancellation filter for use at that time. Similarly, other cancellation filters may additionally or alternatively be provided which are derived from a respective channel frequency response matrix reflecting a spatial channel at a unique respective user-to-device distance, with a device distance sensor being utilised to identify device-to-user distance so as to guide selection of a crosstalk cancellation filter which is appropriate for an extant user distance from the device.

According to another aspect, the present invention provides a system for reducing acoustic crosstalk at a time of audio playback, the system comprising a processor and a memory, said memory containing instructions executable by said processor whereby said system is operative to:

pass a stereo audio signal through a crosstalk canceller, wherein the crosstalk canceller comprises a filter having filter coefficients derived from a decomposition element in which at least one value is adjusted to reduce spectral coloration.

According to a further aspect the present invention provides an electronic device comprising a crosstalk cancellation module in accordance with any of the described embodiments. The electronic device may comprise: a portable device, a computing device; a communications device, a gaming device, a mobile telephone, a personal media player, a laptop, tablet or notebook computing device, a wearable device, or a voice activated device.

In some embodiments of the invention, one or more crosstalk cancellation filters derived in accordance with the present invention may be located on one or more remote servers in a cloud computing environment, and made available for network download by device.

BRIEF DESCRIPTION OF THE DRAWINGS

An example of the invention will now be described with reference to the accompanying drawings, in which.

DETAILED DESCRIPTION OF PREFERRED EMBODIMENTS

Figure 1A:
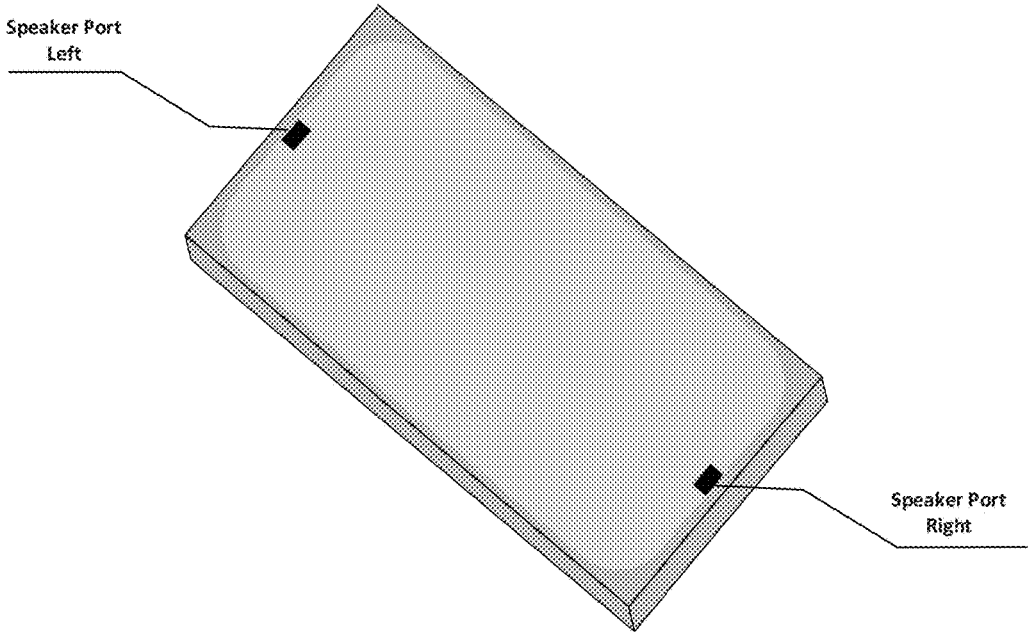
FIGS. 1*a* and 1*b* illustrate a playback device in accordance with one embodiment of the invention.
Figure 1B:
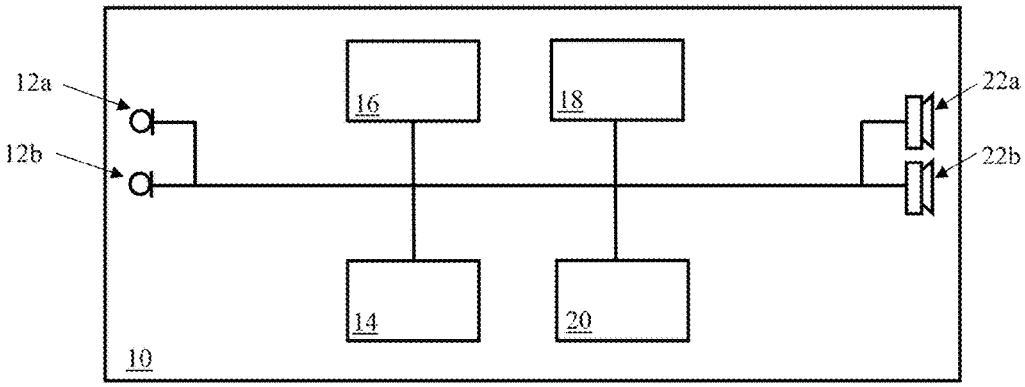

FIG. 1*a* is a perspective view, and FIG. 1*b* is a schematic diagram, illustrating the form of a smartphone 10 in accordance with an embodiment of the present invention. FIG. 1*b* shows various interconnected components of the smartphone 10. It will be appreciated that the smartphone 10 will in practice contain many other components, but the following description is sufficient for an understanding of the present invention. The smartphone 10 is provided with multiple microphones 12*a*, 12*b*, etc, and a memory 14 which may in practice be provided as a single component or as multiple components. The memory 14 is provided for storing data including stereo audio data and program instructions and crosstalk cancellation filter parameters. FIG. 1*b* also shows a processor 16, which again may in practice be provided as a single component or as multiple components. For example, one component of the processor 16 may be an applications processor of the smartphone 10 FIG. 1*b* also shows a transceiver 18, which is provided for allowing the smartphone 10 to communicate with external networks. For example, the transceiver 18 may include circuitry for establishing an internet connection either over a WiFi local area network or over a cellular network. FIG. 1*b* also shows audio processing circuitry 20 for performing operations on stereo audio signals, such as stereo audio signals held in memory 14 or received via transceiver 18 or detected by the microphones 12*a* and 12*b*. In particular the audio processing circuitry 20 is configured to apply crosstalk cancellation to stereo audio signals prior to playback by speakers 22*a*, 22*b*, as discussed in more detail in the following, but may also filter the audio signals or perform other signal processing operations.

Notably, in a compact playback device of this type, the two or more loudspeakers are necessarily mounted relatively close together, such as on the front plane of the device. Due to the small distance between the loudspeakers audio from each speaker is also heard by the contralateral ear. As a consequence, a stereo image in the played audio may be severely deteriorated. In order to restore the original binaural image, the audio signals which propagate along contralateral paths (from the left speaker to the right ear, and from the right speaker to the left ear) must be cancelled or significantly attenuated. These contralateral path signals are collectively called crosstalk. A crosstalk canceller (XTC) is a means to reduce this undesired phenomenon by cancelling the contralateral audio signals while continuing to deliver audio from each loudspeaker to the listener's respective ipsilateral ear, as desired.

Figures 2A, 2B:
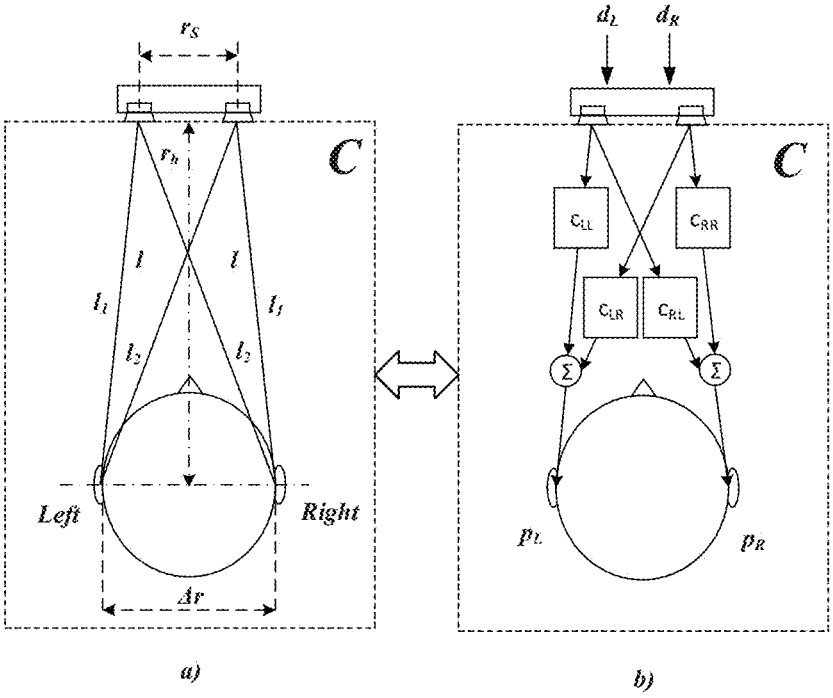
FIG. 2*a* illustrates the spatial geometry of a two-channel free-field playback system with identical loudspeakers.
FIG. 2*b* illustrates the equivalent spatial channel model.

FIG. 2*a* shows the playback geometry of the two-source free-field soundwave propagation model. In this figure, $l_1$ and $l_2$ are the path lengths between each source and the ipsilateral and contralateral ear respectively; $\Delta r$ is the effective distance between the ear canal entrances, $r_S$ is the distance between the centres of the loudspeakers; $r_h$ is the distance between a point equidistant between the two ear canal entrances and a point equidistant between the two loudspeakers. It should be noted that the model is symmetric, so $l_1$ and $l_2$ are the same on each (left and right) side of the model.

The described free-field soundwave propagation model may be represented as a typical two input-two output ("2×2") system depicted in FIG. 2*b*. The frequency response of the spatial channel C, the channel matrix, can be expressed (up to a common propagation delay and attenuation) as follows;

$$C = \begin{bmatrix} C_{LL}(j\omega) & C_{LR}(j\omega) \\ C_{RL}(j\omega) & C_{RR}(j\omega) \end{bmatrix} = \begin{bmatrix} 1 & ge^{-j\omega\tau_S} \\ ge^{-j\omega\tau_S} & 1 \end{bmatrix}, \quad \text{(EQ 1)}$$

where g is the contralateral path attenuation:

$$g = \frac{l_1}{l_2}, \quad \text{(EQ 2)},$$

$\tau_S$ is path delay in seconds:

$$\tau_S = \frac{l_2 - l_1}{c_s}, \quad \text{(EQ 3)}$$

and $c_S$ is the speed of sound (m/s), $\omega=2\pi f$, where f is spectral frequency of the audio signal, and $f_S$ is sampling frequency.

Figure 3:
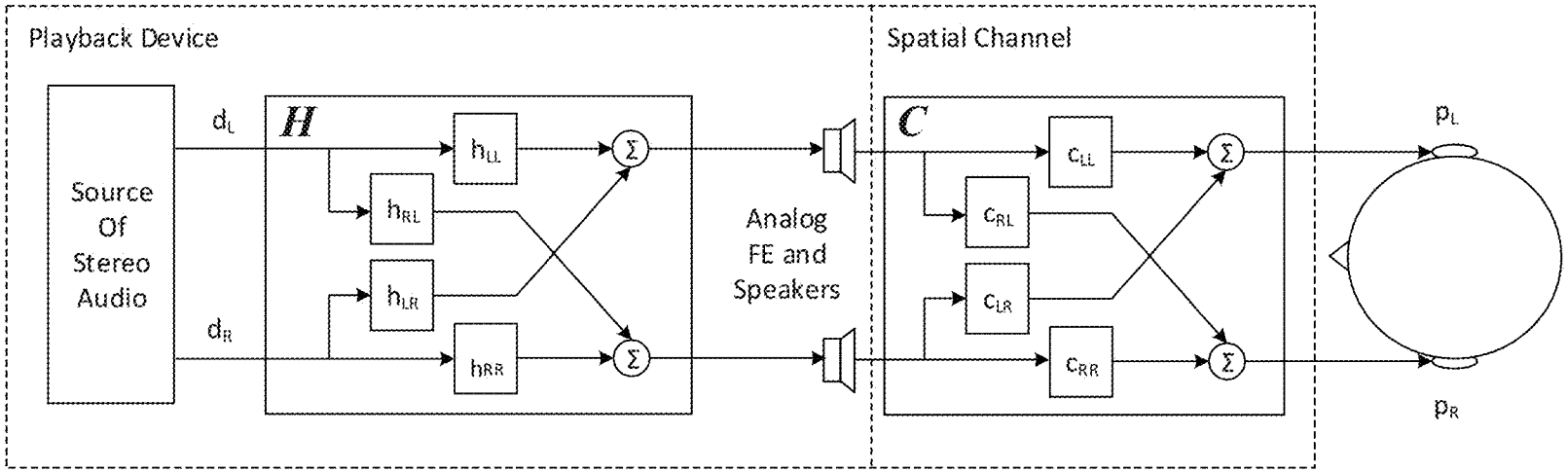
FIG. 3 illustrates a crosstalk canceller in accordance with one embodiment of the invention, and its place in the overall free-field playback system.

Note, that the matrix C is symmetric due to the symmetry of the playback geometry shown in FIG. 2*a*, and therefore $C_{LL}(j\omega)=C_{RR}(j\omega)$ and $C_{LR}(j\omega)=C_{RL}(j\omega)$). FIG. 3 shows the crosstalk canceller, H, and its place in the playback system. Analogous to the spatial channel model, C, the XTC is represented as a two input-two output system with corresponding component filters: $H_{LL}(j\omega)=H_{RR}(j\omega)$ and $H_{LR}(j\omega)=H_{RL}(j\omega)$.

Let $d_L$ and $d_R$ be a $j\omega$-th frequency component of the audio on the left and right channels of a stereo recording respectively; and also let $p_L$ and $p_R$ be a $j\omega$-th frequency component of the audio on the left and right ear canal respectively. The stereo digital audio signal $\vec{d}=[d_L d_R]^T$ is passed through the crosstalk canceller with component filters $H_{LL}(j\omega)$, $H_{RR}(j\omega)$, $H_{LR}(j\omega)$, and $H_{RL}(j\omega)$ in order to cancel or significantly attenuate the crosstalk signal at the listener's ears. The output of the crosstalk canceller is input into the system analog front-ends and loudspeakers and, after propagating through the air, arrives at the listener's ears as $\vec{p}=[p_L p_R]^T$.

The overall input-output equation for the symmetric free-field model shown in FIG. 2*a* can thus be expressed as follows.

$$\vec{p} = CH\vec{d} \quad \text{(EQ 4)}.$$

Hence, as shown in FIG. 3, a digital stereo audio signal $\vec{d}$ represented by left and right channels $d_L$ and $d_R$ from the Source of Stereo Audio is fed into the crosstalk canceller, H. The crosstalk canceller applies the component filters $h_{ij}$ (which are the time domain representations of $H_{ij}(j\omega)$) in accordance with the two input-two output structure. The XTC output, $H\vec{d}$, is then passed though modules (not illustrated) where it may be D/A converted, spectrally shaped, amplified in an Analog Front-End and output to the corresponding loudspeakers. Frequency responses of the analog front-ends and loudspeakers are assumed well-matched. The audio emitted from the loudspeakers propagates through the channel C, which is equivalent to passing the audio signal $H\vec{d}$ through the two input-two output structure with component filters $c_{ij}$ (which are the time domain representations of $C_{ij}(j\omega)$). The component filters $c_{ij}$ of the spatial channel C are fully determined by the playback parameters (geometry, sampling frequency, etc), whereas the component filters of the crosstalk canceller, $h_{ij}$, are chosen such that the crosstalk signal that arrives at each ear from the opposite loudspeaker is cancelled or significantly attenuated.

In general, the crosstalk canceller can be expressed in terms of a linear operator H which, when applied to the original audio signal $\vec{d}$ (see FIG. 3), removes (or significantly attenuates) crosstalk from the audio signal $\vec{p}$ at the listener's ears (as per EQ 4).

For comparison it is noted that perfect (i.e. infinite) crosstalk cancellation is achieved when $H=C^{-1}$, so $$\vec{p}=CH\vec{d}=CC^{-1}\vec{d}=\vec{d} \quad \text{(EQ 5).}$$

In theory this solution completely removes crosstalk, but in practice this method is highly sensitive to the listener's head position, results in excessive spectral coloration at the loudspeaker, which leads to a loss of loudness, and adds a substantial load on both transducers. When the assumed geometry of the playback is violated, such as by the listener moving away from the position shown in FIG. 2, the effect of crosstalk cancellation rapidly and significantly deteriorates, and spectral coloration causes unpleasant sound distortion. Therefore this so-called perfect crosstalk cancellation must actually be avoided in practical systems.

The present invention thus seeks to moderate the amount of crosstalk cancellation achieved at the listener's ears, and to provide a way to control the amount of spectral coloration added by the crosstalk canceller. In accordance with one embodiment of the present invention, a singular value decomposition (SVD) of the crosstalk canceller H is derived, as follows.

It is known that any arbitrary complex matrix, such as the matrix C, can be decomposed into the form:

$$C=U\Lambda V^H \quad \text{(EQ 6)}$$

where in the case of 2×2 matrix C, the 2×2 matrix Λ is given by $$\Lambda=\begin{bmatrix}\lambda_1 & 0\\ 0 & \lambda_2\end{bmatrix} \quad \text{(EQ 7)}$$

and Λ comprises the matrix of 2 singular values $\lambda_1$ and $\lambda_2$ of the 2×2 channel frequency response matrix C. The columns of the 2×2 matrix U comprise the left singular vectors of the matrix C, whereas the columns of the 2×2 matrix V comprise the right singular vectors of the matrix C. The matrices U and V are unitary such that:

$$UU^H=U^HU=I$$

$$VV^H=V^HV=I$$

Usually the singular values $\lambda_1$ and $\lambda_2$ in (EQ 7) are arranged in descending order of magnitude. It is therefore convenient to denote $\Delta_{max}=\lambda_1$, and $\Delta_{min}=\lambda_2$.

It is to be noted that in alternative embodiments the singular values may be calculated from eigenvalue decomposition for certain classes of square matrices, for example, the 2×2 channel C, although as will be appreciated if the channel contains more than 2 speakers then eigenvalue decomposition might not be possible for singular value calculation. Nevertheless, in cases where eigenvalue decomposition is possible, some embodiments of the present invention may utilise eigenvalue decomposition in addition to or in place of singular value decomposition.

It follows that the so-called perfect crosstalk canceller $H=C^{-1}$ can now be represented as:

$$H=V^H\Lambda^+U \quad \text{(EQ 8),}$$

where the matrix $\Lambda^+$ is the pseudo-inverse of Λ and can be written as:

$$\Lambda^+=\begin{bmatrix}1/\lambda_1 & 0\\ 0 & 1/\lambda_2\end{bmatrix}. \quad \text{(EQ 9)}$$

The matrix $\Lambda^+$ is referred to herein as the "XTC gain matrix" for convenience. Thus, once the singular value decomposition of the channel frequency response C (EQ 6) is known, the derivation of the so-called perfect crosstalk canceller, H, is reduced to finding the XTC gain matrix $\Lambda^+$.

However, in accordance with the present embodiment the XTC is configured to perform signal processing with methods and coefficients defined as explained below in order to alleviate the negative effects of the so-called perfect crosstalk cancellation. The XTC processor is so configured, in this embodiment, in a controlled way during the XTC component filter design stage. This embodiment enables a substantial or complete removal of the spectral coloration from the loudspeaker outputs, while nevertheless removing a substantial amount of crosstalk. To this end, it is noted that the gain introduced by the spatial channel is bounded by the largest and the smallest singular values, $\lambda_{max}$ and $\lambda_{min}$, of the channel matrix C. This can be restated as:

$$\lambda_{max}\geq\frac{\|C\vec{d}\|}{\|\vec{d}\|}\geq\lambda_{min} \quad \text{(EQ 10)}$$

where, $\|\bullet\|$ is the matrix $L_2$-norm and $\vec{d}$ is any 2×1 column vector, $\vec{d}\neq 0$.

Figure 4A:
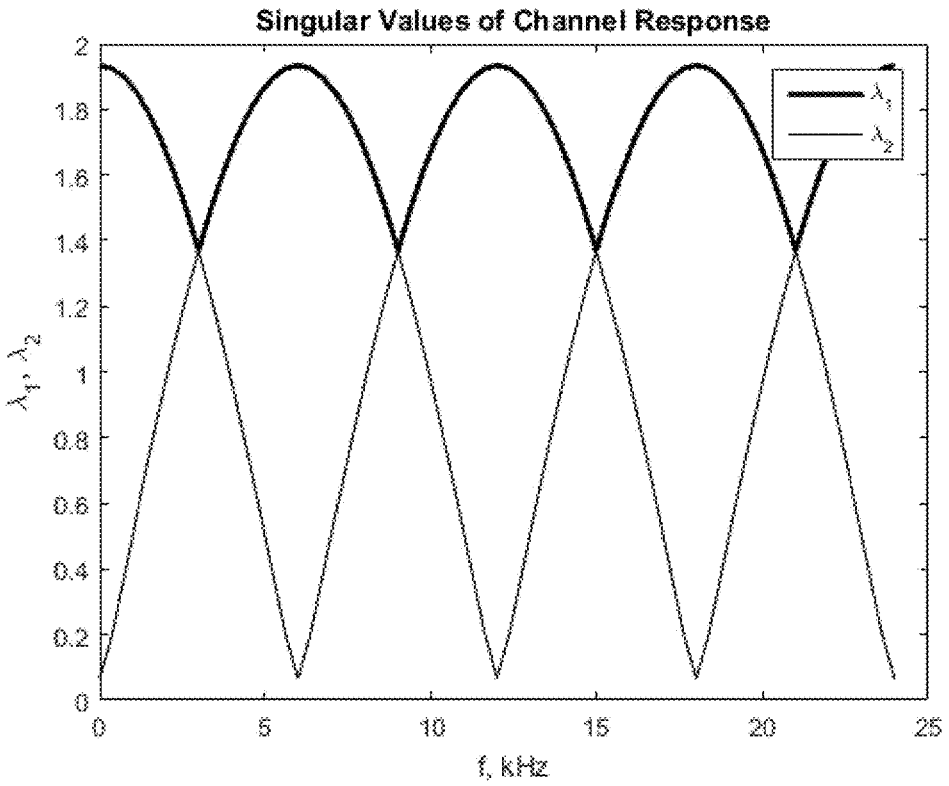
FIG. 4*a* illustrates the values $\lambda_1$ and $\lambda_2$ of a singular value decomposition of a channel matrix, in relation to which coloration removal has not been performed.
Figure 4B:
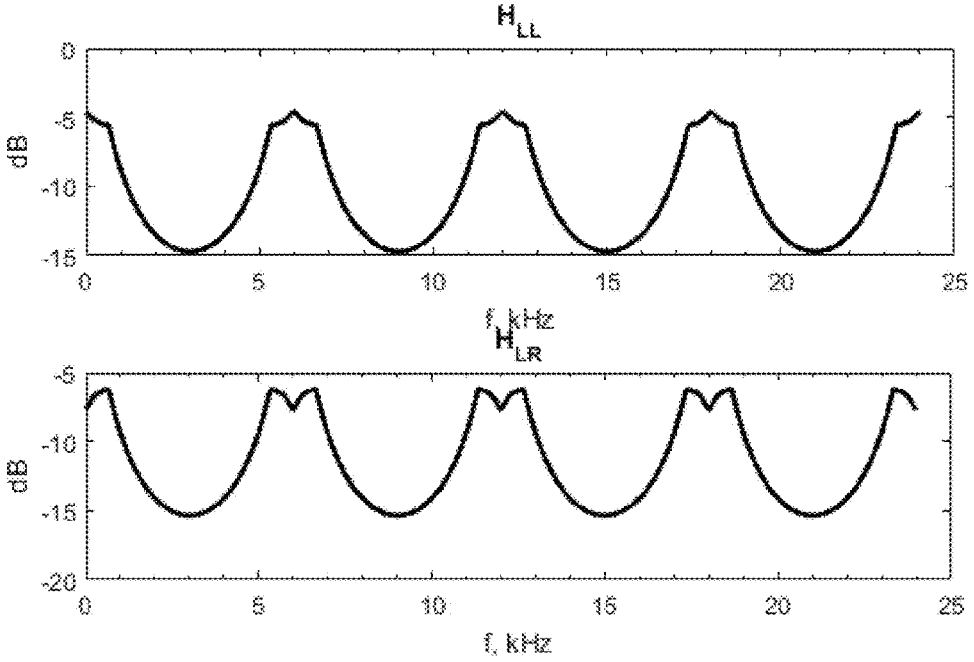
FIG. 4*b* shows the frequency responses of the individual component filters of a crosstalk canceller derived from $\lambda_1$ and $\lambda_2$.
Figure 4C:
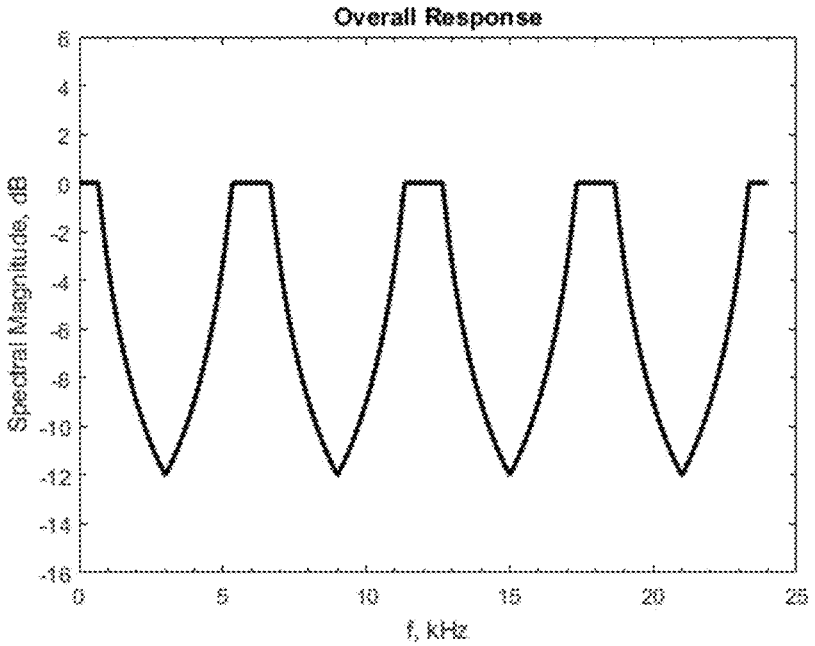
FIG. 4*c* illustrates the combined frequency response of the same crosstalk canceller as FIG. 4*b;*

FIG. 4*a* shows the largest and the smallest singular values, $\lambda_1$ (bold line) and $\lambda_2$ (normal line), of an example channel matrix C, as a function of spectral frequency, f. For each spectral frequency, the channel gain/attenuation is defined by the singular values of the channel C. FIG. 4*b* illustrates the frequency responses of the individual component filters, $H_{LL}$ and $H_{LR}$, for this case. FIG. 4*c* shows the combined frequency response $S(\omega)=\max\{|H_{LL}(j\omega)+H_{LR}(j\omega)|, |H_{LL}(j\omega)-H_{LR}(j\omega)|\}$ of the crosstalk canceller H of FIG. 4. S(ω) takes this form because the L and R stereo audio signals may be in phase or out of phase, and the combined frequency response metric S(w) represents both cases, being the frequency response to an in-phase input and the frequency response to an out-of-phase input. It can be seen that if $\lambda_2$ takes the values shown in FIG. 4*a*, then the individual filters $H_{LL}$ and $H_{LR}$ are not all-pass filters, and moreover the combined frequency response S of the crosstalk canceller H suffers 12 dB spectral coloration. Therefore the crosstalk canceller H of FIG. 4 introduces coloration at the loudspeakers. This inhibits the achievable loudness and produces unpleasant audio distortions as a result of applying crosstalk cancellation.

Thus, in order to cancel crosstalk, the so-called perfect crosstalk canceller H must apply a gain (or attenuation) which is the inverse of the spectral coloration stipulated by the channel, $1/\lambda_{max}$ and $1/\lambda_{min}$ respectively. As a result, the so-called perfect XTC causes a spectral coloration at the loudspeaker, which is an inverse to the spectral coloration at the ear, caused by the channel C.

However, the present embodiment recognises that the amount of spectral coloration added to the original audio by the XTC is conveniently represented by the combined frequency response-maximal gain which may be observed at the input of a loudspeaker $$S(\omega)=\max\{|H_{LL}(j\omega)+H_{LR}(j\omega)|,|H_{LL}(j\omega)-H_{LR}(j\omega)|\}. \quad \text{(EQ 11)}$$

The present embodiment further recognises that setting one of the singular values to be constant, while the other varies with frequency, can partly or completely remove spectral coloration. In particular, the so-called perfect XTC is the inverse of the spatial channel C, and so by virtue of inverse singular value decomposition the so-called perfect XTC's singular values are $1/\lambda_1$ and $1/\lambda_2$ in each frequency bin. Further, the maximum gain of an XTC system is bounded by the maximum of the $(1/\lambda_2)$, per EQ 10. Thus when, in accordance with the present invention, $1/\lambda_2$ is set to a constant value (by altering the value of $\lambda_2$) across all frequencies (and the value of $1/\lambda_1$ is smaller than 1), the coloration (as defined in EQ 11) will be constant and smaller than 0 dB. Accordingly in the present embodiment, in order for the crosstalk canceller to cause no spectral coloration from its combined frequency response, it is sufficient in (EQ 8) to set the lower bound of the XTC gain matrix $\Lambda^+$ to be the inverse of the largest minimal singular value of the channel matrix. This can be stated as follows:

$$\tilde{\Lambda}^+ = \begin{bmatrix} 1/\lambda_1 & 0 \\ 0 & 1/\tilde{\lambda} \end{bmatrix}, \quad \text{(EQ 12a)}$$

where $$\tilde{\lambda}=\max_f(\lambda_2) \quad \text{(EQ 13).}$$

Note, equation 12a is denoted as such because an alternative, equation 12b, is presented in the following.

Thus the crosstalk canceller, $\tilde{H}$, provided by the present embodiment of the invention is given by:

$$\tilde{H}=V^H\tilde{\Lambda}^+U \quad \text{(EQ 14).}$$

Importantly, and in contrast to the so-called perfect crosstalk canceller H, the crosstalk canceller $\tilde{H}$ of the present embodiment causes no spectral coloration at the loudspeaker. Removing spectral coloration in accordance with the present embodiment also reduces how much destructive interference is accomplished in the contralateral paths, and therefore reduces the amount of cancelled crosstalk. That is, the reduction or elimination of spectral coloration in accordance with the present embodiment involves a trade off in the form of a controllable reduction in the crosstalk cancellation effect.

Figure 5A:
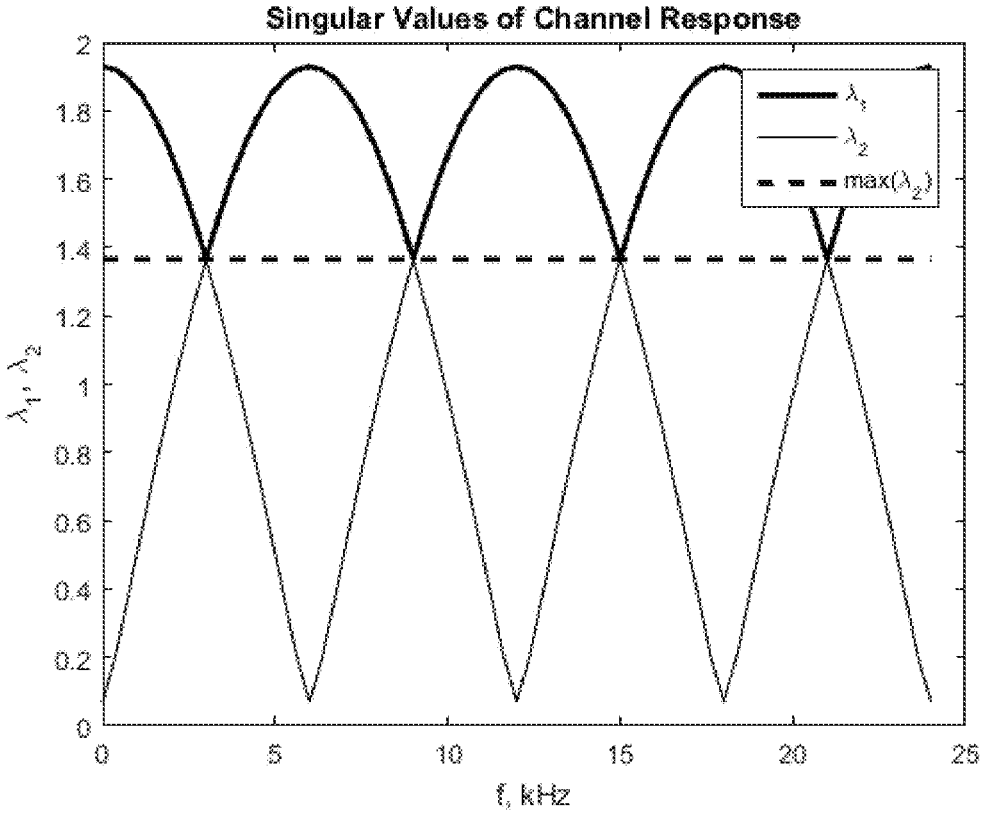
FIG. 5*a* illustrates the values $\lambda_1$ and $\tilde{\lambda}$ of a singular value decomposition of a channel matrix, in relation to which coloration removal has been performed in accordance with one embodiment of the present invention, together with the pre-removal $\lambda_2$ for comparison.
Figure 5B:
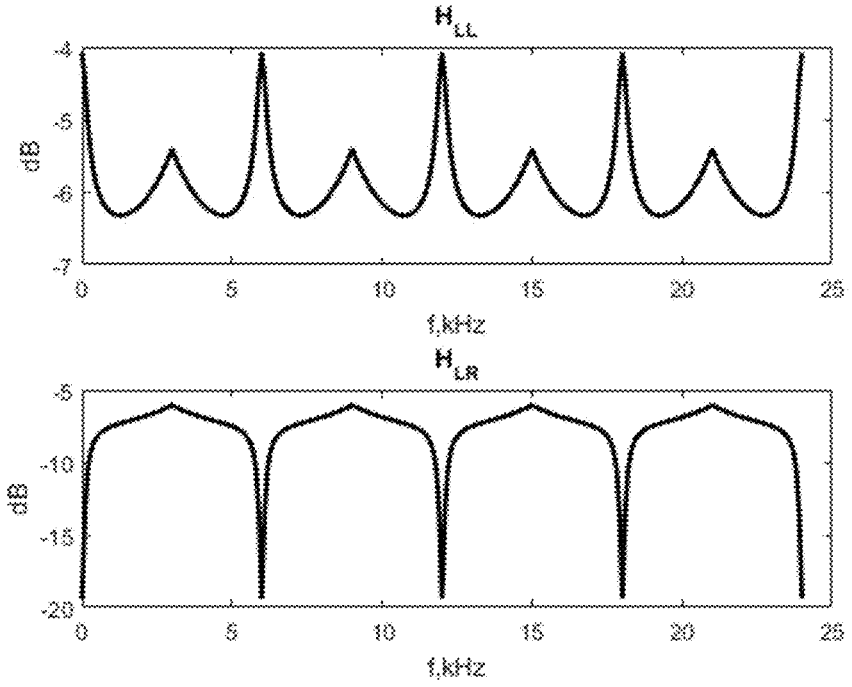
FIG. 5*b* shows the frequency responses of the individual component filters of the coloration-free crosstalk canceller derived from $\lambda_1$ and $\tilde{\lambda}$.
Figure 5C:
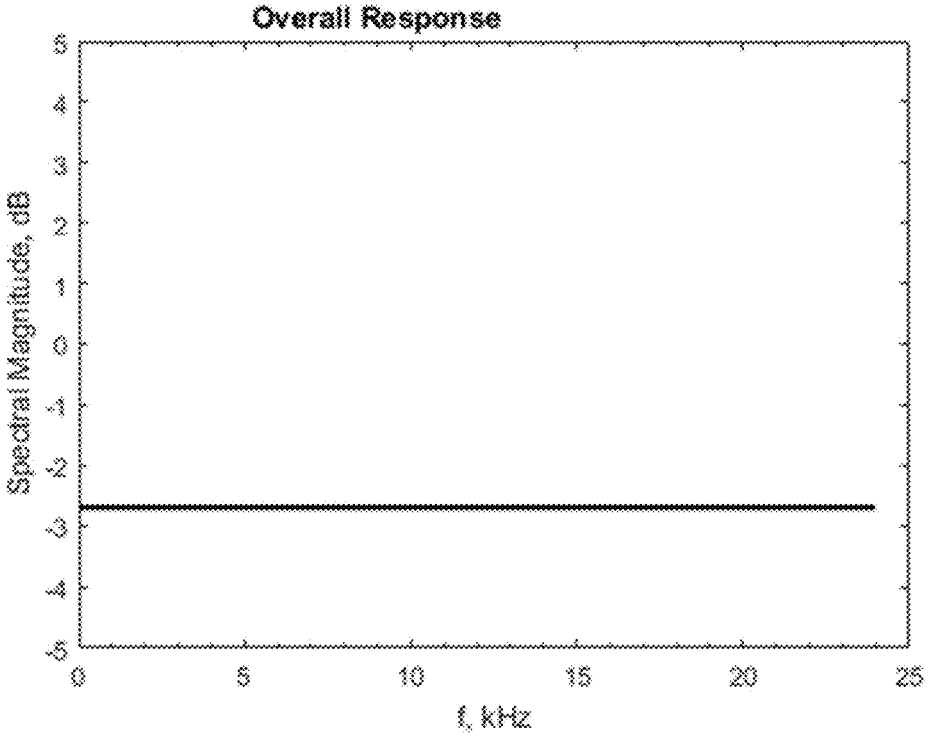
FIG. 5*c* illustrates the combined frequency response of the crosstalk canceller.

FIG. 5*a* shows the plots of singular values, $\lambda_1$, $\lambda_2$, and $\tilde{\lambda}=\max_f(\lambda_2)$ of an example channel matrix C, as a function of spectral frequency, f. FIG. 5*b* shows the frequency responses of the individual component filters, $\tilde{H}_{LL}$ and $\tilde{H}_{LR}$. FIG. 5*c* shows the combined frequency response $\tilde{S}(\omega)=\max\{|\tilde{H}_{LL}(j\omega)+\tilde{H}_{LR}(j\omega)|, |\tilde{H}_{LL}(j\omega)-\tilde{H}_{LR}(j\omega)|\}$ of the crosstalk canceller R of the present embodiment. It can be seen that if $\tilde{\lambda}$ is chosen according to (EQ 13) then, although the individual filters $\tilde{H}_{LL}$ and $\tilde{H}_{LR}$ are not all-pass filters, the combined frequency response S of the crosstalk canceller $\tilde{H}$ is flat. Therefore the crosstalk canceller $\tilde{H}$ of the present embodiment introduces no spectral coloration at the loudspeakers. This leads to a crosstalk canceller with improved loudness and minimises unpleasant audio distortions due to crosstalk cancellation.

It is further noted from EQ 12a that the maximum gain from cross talk canceller filters $\tilde{H}$ is $1/\tilde{\lambda}$. If $\tilde{\lambda}$ is greater than 1, $\tilde{H}$ attenuates the output signal, which results in a loss of loudness. If $\tilde{\lambda}$ is smaller than 1, $\tilde{H}$ could clip the output signal. Therefore in a preferred embodiment of the invention $\tilde{H}$ is normalized to provide 0 dB maximum gain.

$$\tilde{\Lambda}^+ = \begin{bmatrix} \tilde{\lambda}/\lambda_1 & 0 \\ 0 & 1 \end{bmatrix}, \quad \text{(EQ 12b)}$$

Figure 6A:
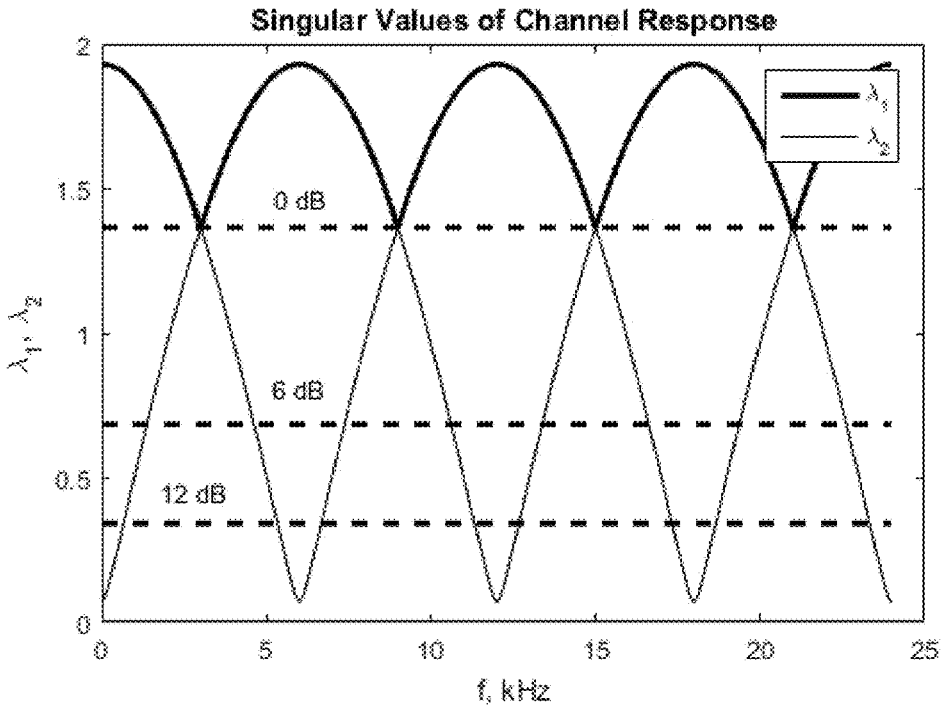
FIGS. 6*a* and 6*b* illustrate the effect of limiting the singular value $\lambda_2$ by varying degrees upon the resulting spectral coloration which arises in the overall combined frequency response.
Figure 6B:
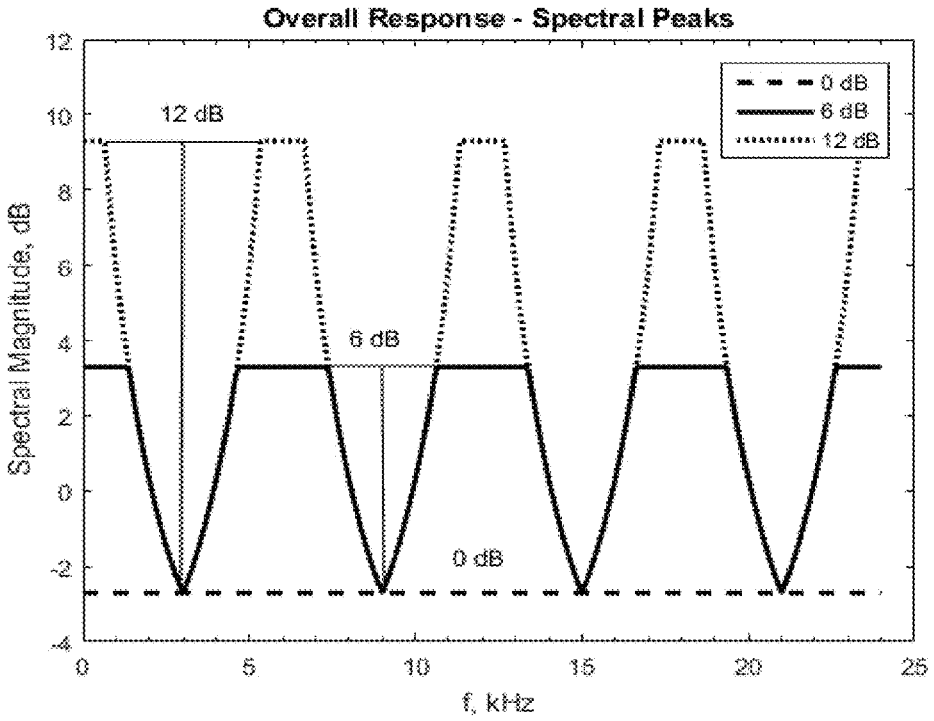

Thus, adjusting the singular value $\lambda_2$ to take the value $\tilde{\lambda}=\max_f(\lambda_2)$ as illustrated in FIG. 5*a* results in the combined frequency response $\tilde{S}$ of the crosstalk canceller $\tilde{H}$ being flat. This embodiment therefore entirely solves the spectral coloration problem faced by other crosstalk cancellation methods. However, it is to be appreciated that the present invention also extends to other embodiments in which $\lambda_2$ is adjusted so as to take a value $\tilde{\lambda}$ which is anywhere in the range $\min_f(\lambda_2)<\tilde{\lambda}<\max_f(\lambda_2)$. That is, any such adjustment to $\lambda_2$ results in reduced spectral coloration, even if not completely eliminating spectral coloration as in FIG. 5*c*, and all such embodiments which partially reduce spectral coloration are within the scope of the present invention. FIGS. 6*a* and 6*b* illustrate a number of such embodiments.

In particular, FIGS. 6*a* and 6*b* illustrate the effect of limiting the singular value $\lambda_2$ by varying degrees, upon the resulting spectral coloration which arises in the overall response. The embodiment of FIG. 5 is shown for comparison, and again it may be seen that setting $\lambda_2$ to a value $\tilde{\lambda}=\max_f(\lambda_2)$, as indicated by the "0 dB" line in FIG. 6(*a*), will force spectral coloration to be 0 dB, as shown by the "0 dB" line in FIG. 6(*b*). In another embodiment, setting $\lambda_2$ to a value of 0.68 as indicated by the "6 dB" line in FIG. 6(*a*), will force spectral coloration to be 6 dB as indicated by the "6 dB" line in FIG. 6(*b*). In yet another embodiment, setting $\lambda_2$ to 0.34, as indicated by the "12 dB" line in FIG. 6(*a*), will force spectral coloration to be 12 dB, as indicated by the "12 dB" line in FIG. 6(*b*). Thus, the present invention provides for a range of embodiments in which appropriate adjustment of the singular value $\lambda_2$ results in spectral coloration which is reduced (improved) by a desired amount, including complete elimination of spectral coloration as in the embodiment of FIG. 5.

Figure 7:
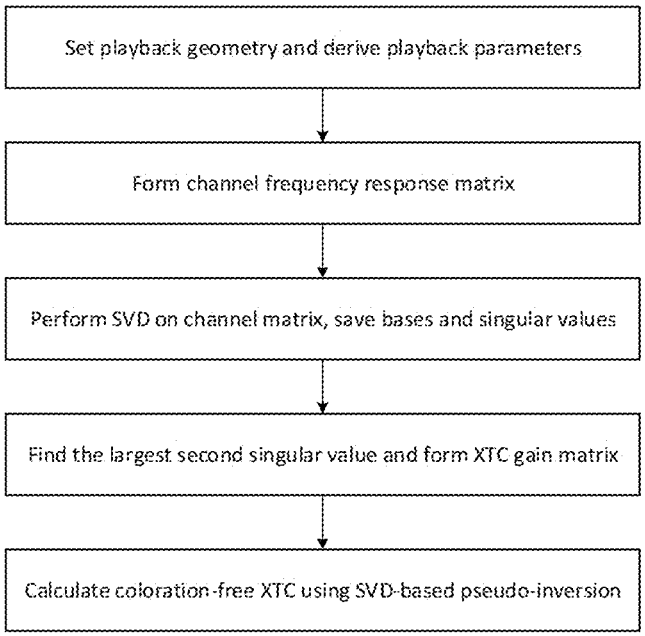
FIG. 7 illustrates an algorithmic structure for deriving a coloration-free crosstalk canceller in accordance with one embodiment of the invention.

A further embodiment of the invention provides for a method for SVD-XTC Design. The algorithmic structure of the coloration-free XTC derivation method is shown in FIG. 7. The proposed method of the XTC design is as follows.

Step 1: for a particular use case, e.g. music video playback on a mobile phone, define an input parameter vector $\vec{u}=[r_S, r_h, \Delta r, f_S]$, where $f_S$(Hz) is the sampling frequency.

Step 2: Calculate playback geometry parameters: $l_1$, $l_2$ and the path difference, $\Delta l$ $$l_1=\sqrt{(0.5\Delta r-0.5r_s)^2+r_h^2} \quad \text{(EQ 15)}$$

$$l_2=\sqrt{(0.5\Delta r+0.5r_s)^2+r_h^2} \quad \text{(EQ 16)}$$

$$\Delta l=l_2-l_1 \quad \text{(EQ 17)}$$

Step 3: Calculate channel parameters: path attenuation g, path delay in seconds $\tau_S$ as per EQ 2-3 respectively. Alternatively, the parameters can be obtained by corresponding measurements.

Step 4: Form the channel frequency response C using (EQ 1).

Step 5: For all spectral frequencies $[0-f_S/2]$ Hz perform SVD decomposition of C using (EQ 6). Save bases U, V, and singular values ($\lambda_1$ and $\lambda_2$).

Step 6: Find $\tilde{\lambda}$ using (EQ 13).

Step 7: Form the XTC gain matrix $\tilde{\Lambda}^+$ using EQ 12a, or the normalised gain matrix $\tilde{\Lambda}^+$ defined by EQ 12b.

Step 8: Calculate the target XTC $\tilde{H}$ with (EQ 14) using $\tilde{\Lambda}^+$ and saved bases U, V estimated at step 5.

Step 9: Construct the XTC impulse response, represented by its component filters $h_{ij}$ by performing an n-point inverse DFT (IDFT) on $\tilde{H}$, followed by a cyclic shift of n/2. Calculated component filters coefficients are loaded into the two-input two-output filter structure H (FIG. 3) and need no further change unless the playback geometry, which is stipulated by the playback scenario, has changed.

The skilled person will thus recognise that some aspects of the above-described apparatus and methods, for example the calculations performed by the processor may be embodied as processor control code, for example on a non-volatile carrier medium such as a disk, CD- or DVD-ROM, programmed memory such as read only memory (firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

Embodiments of the invention may be arranged as part of an audio processing circuit, for instance an audio circuit which may be provided in a host device. A circuit according to an embodiment of the present invention may be implemented as an integrated circuit.

Embodiments may be implemented in a host device, especially a portable and/or battery powered host device such as a mobile telephone, an audio player, a video player, a PDA, a mobile computing platform such as a laptop computer or tablet and/or a games device for example. Embodiments of the invention may also be implemented wholly or partially in accessories attachable to a host device, for example in active speakers or headsets or the like. Embodiments may be implemented in other forms of device such as a remote controller device, a toy, a machine such as a robot, a home automation controller or the like.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference signs in the claims shall not be construed so as to limit their scope.

It will be appreciated by persons skilled in the art that numerous variations and/or modifications may be made to the invention as shown in the specific embodiments without departing from the spirit or scope of the invention as broadly described. For example, the XTC filtering in other embodiments may be implemented in the frequency domain by applying a FFT to each channel, then multiplying by $H_{ij}$, applying an IFFT, and applying a suitable overlap-add. The present embodiments are, therefore, to be considered in all respects as illustrative and not restrictive.

The invention claimed is:

1. A device for reducing acoustic crosstalk at a time of audio playback, the device comprising:

a processor configured to pass a stereo audio signal through a crosstalk canceller, wherein the crosstalk canceller comprises a filter having filter coefficients derived from a decomposition element in which at least one value is adjusted to reduce spectral coloration, wherein the decomposition element is a matrix decomposition of a channel frequency response matrix, and the decomposition element contains values which comprise, or are derived from, singular values or eigenvalues.

2. The device of claim 1 wherein the decomposition element is a singular value decomposition element of a channel frequency response matrix, and wherein the value adjusted is a singular value.

3. The device of claim 2 wherein a singular value having smallest magnitude is adjusted to take a value $\tilde{\lambda}$ across all frequencies.

4. The device of claim 2 wherein the decomposition element is a pseudo-inverse of a singular value matrix comprising at least one adjusted singular value.

5. The device of claim 1 wherein the decomposition element is normalised to provide 0 dB maximum gain.

6. The device of claim 1 wherein the decomposition element is an eigenvalue decomposition element of a channel frequency response matrix, and wherein the value adjusted is an eigenvalue.

7. A method of reducing acoustic crosstalk at a time of audio playback, the method comprising:

passing a stereo audio signal through a crosstalk canceller, wherein the crosstalk canceller comprises a filter having filter coefficients derived from a decomposition element in which at least one value is adjusted to reduce spectral coloration, wherein the decomposition element is a matrix decomposition of a channel frequency response matrix, and the decomposition element contains values which comprise, or are derived from, singular values or eigenvalues.

8. The method of claim 7 wherein the decomposition element is a singular value decomposition element of a channel frequency response matrix, and wherein the value adjusted is a singular value.

9. The method of claim 8 wherein a singular value having smallest magnitude is adjusted to take a value $\tilde{\lambda}$ across all frequencies.

10. The method of claim 8 wherein the decomposition element is a pseudo-inverse of a singular value matrix comprising at least one adjusted singular value.

11. The method of claim 7 wherein the decomposition element is normalised to provide 0 dB maximum gain.

12. The method of claim 7 wherein the decomposition element is an eigenvalue decomposition element of a channel frequency response matrix, and wherein the value adjusted is an eigenvalue.

13. A method of designing a crosstalk canceller for reducing acoustic crosstalk at a time of audio playback, the method comprising:

forming a channel frequency response for a nominated playback geometry;

decomposing the channel frequency response to derive a decomposition element, the decomposition element being a matrix decomposition of the channel frequency response matrix, and the decomposition element containing values which comprise, or are derived from, singular values or eigenvalues;

adjusting a value of the decomposition element to reduce spectral coloration; and deriving crosstalk canceller filter coefficients from the adjusted value of the decomposition element.

14. The method of claim 13 wherein the decomposition element is a singular value decomposition element of a channel frequency response matrix, and wherein the value adjusted is a singular value.

15. The method of claim 14 wherein a singular value having smallest magnitude is adjusted to take a value $\tilde{\lambda}$ across all frequencies.

16. The method of claim 14 wherein the decomposition element is a pseudo-inverse of a singular value matrix comprising at least one adjusted singular value.

17. The method of claim 13 wherein the decomposition element is normalised to provide 0 dB maximum gain.

18. The method of claim 13 wherein the decomposition element is an eigenvalue decomposition element of a channel frequency response matrix, and wherein the value adjusted is an eigenvalue.

19. A non-transitory computer readable medium for reducing acoustic crosstalk at a time of audio playback, comprising instructions which, when executed by one or more processors, causes passing of a stereo audio signal through a crosstalk canceller, wherein the crosstalk canceller comprises a filter having filter coefficients derived from a decomposition element in which at least one value is adjusted to reduce spectral coloration, wherein the decomposition element is a matrix decomposition of a channel frequency response matrix, and the decomposition element contains values which comprise, or are derived from, singular values or eigenvalues.

20. The non-transitory computer readable medium of claim 19 wherein the decomposition element is a singular value decomposition element, and wherein the value adjusted is a singular value.

21. The non-transitory computer readable medium of claim 20 wherein a singular value having smallest magnitude is adjusted to take a value $\tilde{\lambda}$ across all frequencies.

22. The non-transitory computer readable medium of claim 20 wherein the decomposition element is a pseudo-inverse of a singular value matrix comprising at least one adjusted singular value.

23. The non-transitory computer readable medium of claim 19 wherein the decomposition element is normalised to provide 0 dB maximum gain.

24. The non-transitory computer readable medium of claim 19 wherein the decomposition element is an eigenvalue decomposition element, and wherein the value adjusted is an eigenvalue.

25. A system for reducing acoustic crosstalk at a time of audio playback, the system comprising a processor and a memory, said memory containing instructions executable by said processor whereby said system is operative to:

pass a stereo audio signal through a crosstalk canceller, wherein the crosstalk canceller comprises a filter having filter coefficients derived from a decomposition element in which at least one value is adjusted to reduce spectral coloration, and wherein the decomposition element is a matrix decomposition of a channel frequency response matrix, and the decomposition element contains values which comprise, or are derived from, singular values or eigenvalues.

* * * * *